US005683799A

United States Patent [19]

Olinger

[11] Patent Number: 5,683,799

[45] Date of Patent: Nov. 4, 1997

[54] INSULATION AND STRUCTURAL PANEL

[75] Inventor: John L. Olinger, Newark, Ohio

[73] Assignee: Owens Corning Fiberglas Technology, Inc., Summit, Ill.

[21] Appl. No.: 372,542

[22] Filed: Jan. 13, 1995

[51] Int. Cl.[6] ..... B32B 3/26

[52] U.S. Cl. ..... 428/313.9; 428/316.6; 428/319.3; 428/319.7; 428/319.9

[58] Field of Search ..... 428/316.6, 317.9, 428/305.5, 311.5, 313.9, 319.3, 319.7, 319.9; 752/309.7, 309.16, DIG. 7

[56] References Cited

U.S. PATENT DOCUMENTS

| | | | |
|---|---|---|---|
| 3,179,549 | 4/1965 | Strong et al. | 161/43 |
| 3,769,126 | 10/1973 | Kolek | 156/172 |
| 4,039,718 | 8/1977 | Kallenborn | 428/398 |
| 4,067,829 | 1/1978 | Garrett | 260/2.5 F |
| 4,292,214 | 9/1981 | Blount | 260/9 |
| 4,444,821 | 4/1984 | Young et al. | 428/69 |
| 4,689,255 | 8/1987 | Smoot et al. | 428/77 |
| 4,754,514 | 7/1988 | Limb et al. | 5/502 |
| 5,420,206 | 5/1995 | Mason et al. | 525/179 |

FOREIGN PATENT DOCUMENTS

| | | |
|---|---|---|
| 0254993 | 2/1988 | European Pat. Off. . |
| 472388 | 2/1992 | European Pat. Off. . |
| WO9012686 | 11/1990 | WIPO . |
| WO9415034 | 7/1994 | WIPO . |

*Primary Examiner*—Christopher Raimund

*Attorney, Agent, or Firm*—C. Michael Gegenheimer; Curtis B. Brueske

[57] ABSTRACT

An insulation and structural panel is disclosed. The panel includes a resin matrix which has a thermal conductivity less than about 1.3 BTU-in/hrFt$^2$°F. in the unreinforced condition, and hollow glass fibers. The hollow glass fibers have a void fraction within the range of from about 20 to about 50 percent, and the panel has a thermal conductivity of less than about 1.6 BTU-in/hrFt$^2$°F. The hollow glass fibers comprise form 60 to 95 percent by weight of the panel.

20 Claims, 1 Drawing Sheet

INSULATION AND STRUCTURAL PANEL

TECHNICAL FIELD

This invention pertains to construction materials in the form of building panels having good insulation values as well as structural properties. More particularly, this invention pertains to insulation and structural panels comprised of a resin matrix and reinforcement fibers.

BACKGROUND

Structural panels useful for buildings and containers are well known to be made of wood and wood fibers, ceramic materials, cements, stone, resinous materials, foams, and other similar materials. The types of materials having good insualative values as well as good structural properties are more limited. Structural panels having good thermal values include foams, composites or sandwich structures containing a central layer of fiberglass insulation, and panels containing vacuum insulation envelopes or structures.

Self-supporting foam panels have been used widely, and they include urethane foams, polystyrene foams, phenolic foams and others. Foam panels typically have a thermal insulating value of 5 to 8 R's per inch, where R is the inverse of the thermal conductivity of the material, expressed as BTU-in/hrFt$^{2}$°F. Typical glass fiber insulation and structural panels typically have a thermal insulating value of 3 to 4 R's per inch. At the other end of the spectrum are super insulation materials which have thermal insulating values of 50 to 100 R's per inch, or greater. These super insulation panels typically require high vacuums as well as sophisticated materials to act as the envelope for maintaining the vacuum. The cost of super insulation panels is considerably higher than panels made of less sophisticated materials, such as fiber glass, for example. It would be advantageous if there could be developed an insulation and structural panel which has structural and insulation properties between those of foams and super insulation panels.

Commonly used materials for structural panels are resins, both thermoplastic and thermoset. These panels are used for building materials, such as walls, as well as structural parts for equipment such as furniture, appliances, and automobiles. Typical thermoplastic resins for structural panels include polyvinylchloride, polycarbonate, polystyrene and polypropylene. Typical thermoset resins used are polyesters, epoxies, phenolics and polyurethanes.

The insulation value of resinous structural panels can be improved by introducing air or other gases into the resin matrix. Typically this is accomplished by foaming the resin with a blowing agent. Foaming not only makes the resin less dense and therefore lighter in weight, but also greatly improves, i.e., lowers, the thermal conductivity of the resin. Foaming the resin leaves the panel in a structurally weaker condition, however.

In many applications resinous structural panels are composite panels strengthened by reinforcing them with fibers, either with mineral fibers such as glass fibers, or with organic fibers such as nylon or rayon fibers. Often the resin matrix will contain up to 70 or 80 percent by weight reinforcement fibers. One of the problems with introducing some reinforcement materials, such as glass fibers, into the resin matrix is that the glass has a higher thermal conductivity or "k-value" than the resin has, and therefore the addition of the glass fibers increases the overall thermal conductivity of the composite panel. Although other, non glass, reinforcement fibers may have lower thermal conductivities than glass fibers, glass fibers are preferred because of the lower material cost, the general inertness of the glass fibers, the dimensional stability of glass fibers, and the lack of contribution of fuel or smoke-causing material in a fire. It would be advantageous to be able to make structural panels having moderately high insulation values by using a resinous matrix which is reinforced with glass fibers.

DISCLOSURE OF INVENTION

There has now been developed an insulation and structural panel which has moderately high insulation values, a relatively high glass loading, and a relatively low cost. The insulation and structural panel of the invention solves the problems described above by reinforcing a resinous matrix with hollow glass fibers. The hollow glass fibers have a void fraction within the range of from about 20 to about 50 percent. The resin matrix, in o the absence of the glass fibers, is of the type which has a low thermal conductivity, i.e., less than about 1.3 BTU-in/hrFt$^{2}$°F. in the unreinforced condition. The composite panel with both the resin matrix and the reinforcement fibers has an overall thermal conductivity less than about 1.6 BTU-in/hrFt$^{2}$°F.

According to this invention, there is provided an insulation and structural panel comprising a resin matrix which has a thermal conductivity less than about 1.3 BTU-in/hrFt$^{2}$°F. in the unreinforced condition, and hollow glass fibers, the hollow glass fibers having a void fraction within the range of from about 20 to about 50 percent, the panel having a thermal conductivity less than about 1.6 BTU-in/hrFt$^{2}$°F. Preferably, the resin has a thermal conductivity less than about 0.8 BTU-in/hrFt$^{2}$°F. in the unreinforced condition. This can be accomplished by foaming the resin. With a foamed resin, the overall thermal conductivity can be lower than about 1.0 BTU-in/ hrFt$^{2}$°F.

In a specific embodiment of the invention, the resin matrix comprises an amount within the range of from about 5 to about 40 percent of the weight of the panel, and the glass fibers comprise an amount within the range of from about 60 to about 95 percent of the weight of the panel. Preferably, the glass fibers comprise an amount within the range of from about 80 to about 95 percent of the weight of the panel.

In yet another embodiment of the invention, the hollow glass fibers have a reflective coating on their interior surfaces, the reflectivity of the interior surfaces being greater than about 0.4 Preferably, the reflectivity is greater than about 0.6.

In another embodiment of the invention, the resin matrix is one or more resin from the group consisting of polyvinylchloride, polycarbonate, polystyrene, polypropylene, phenolic, epoxy, polyester and polyurethane.

In yet another embodiment of the invention, the glass fibers are evacuated to a pressure of $10^{-4}$ torr. This will slightly improve the thermal conductivity of an unfoamed composite structure. Greater improvement of thermal performance is obtained with a formed resin matrix which is put in combination with a hollow glass fiber having an interior infrared reflective coating. Another means for improving the thermal conductivity of the composite structure is to fill the glass fibers with a low conductivity gas having a thermal conductivity less than about 0.15 BTU-in/hrFt$^{2}$°F.

In another embodiment of the invention the resin matrix has a thermal conductivity within the range of from 0.08 BTU-in/hrFt$^{2}$°F. to about 1.3 BTU-in/hrFt$^{2}$°F. in the unreinforced condition, and the panel has a thermal conductivity within the range of from about 0.3 BTU-in/hrFt$^{2}$°F. to about 1.6 BTU-in/hrFt$^{2}$°F.

BEST MODE FOR CARRYING OUT THE INVENTION

Figure 1:
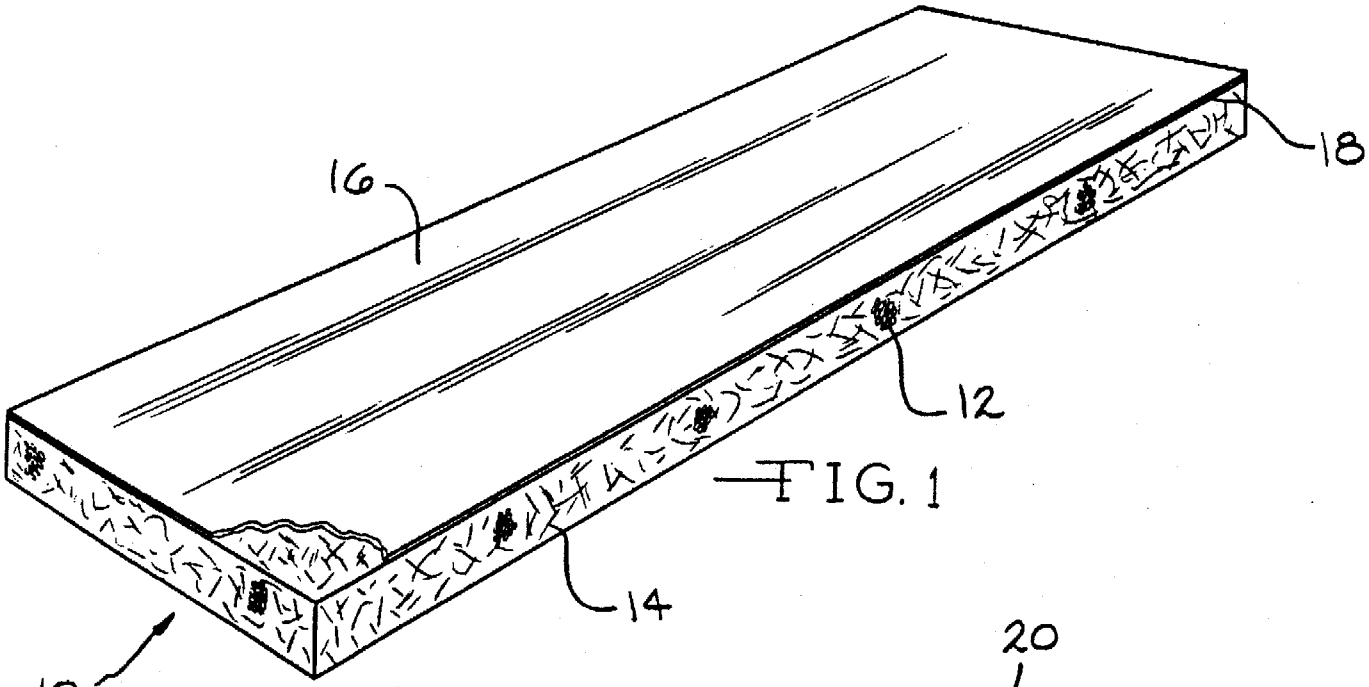
FIG. 1 is a schematic view in perspective of an insulation and structural panel of the invention.

The invention will be described using glass fibers, although it is to be understood that the invention can be practiced using fibers of other heat softenable mineral material, such as rock, slag, and basalt.

As shown in the drawings, insulation and structural panel 10 is comprised of a resinous matrix, such as structural foam 12 and reinforcement fibers, such as glass fibers 14. The major face of the panel 16 is coated with an optional coating, which can be any surfacing layer, such as a gel coat. 18, or an adhered film of thermoplastic resin.

Figure 2:
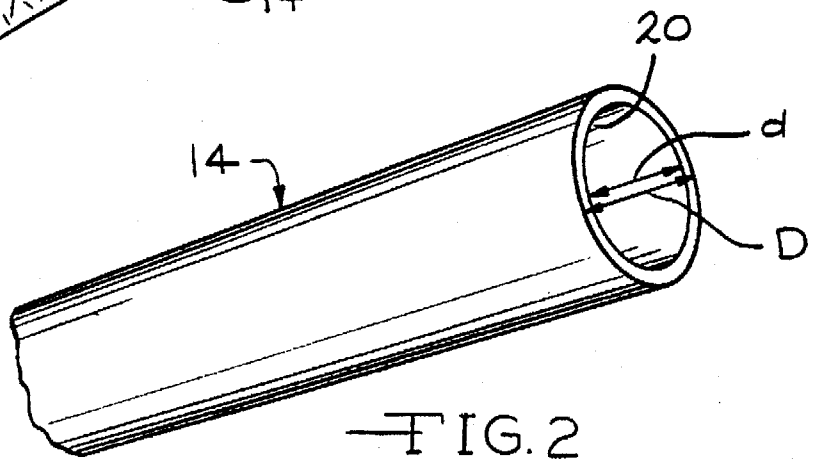
FIG. 2 is a schematic view in perspective illustrating some of the details of a glass fiber reinforcement used with the invention.

As shown in FIG. 2, the reinforcement fibers 14 are hollow, with interior surfaces 20. A cross section of the hollow glass fibers shows that the reinforcement fibers have an outside diameter is D and the inside diameter is d.

The resinous material can be any resinous substance with enough rigidity to provide the desired stiffness for the product. Preferably the resinous material is a thermoplastic material having a generally low thermal conductivity which is less than about 1.3 BTU-in/hrFt$^2$°F. The thermal conductivity is that of the unfoamed resin alone, and not with any reinforcement material. Preferred thermoplastic materials include polyvinylchloride, polycarbonate, polystyrene and polypropylene. Other resins suitable for use with the invention include epoxies, polyesters, phelolics, and polyurethanes, and possibly other thermoset materials. It is desirable that the resin have a low thermal conductivity value.

Preferably, the resin is one that can be foamed easily, and has a low thermal conductivity in the foamed, unreinforced condition. Air or other lower thermal conductivity gases can be introduced into the resinous matrix, either as a blowing agent during a foaming step, or as bubbles in a mixing or frothing process.

The reinforcement fibers can be any mineral fibers, but preferably are glass fibers. Hollow glass fibers can be produced in several ways known to those skilled in the art, and are commercially available from Owens-Corning Fiberglas Corporation, Toledo, Ohio. Hollow glass fibers are characterized in terms of the void fraction, which is the percentage of the cross sectional area of the fiber that is void of glass. For example, the total cross-sectional area of glass fiber 14 is $\pi D^2/4$, the cross-sectional area of the void space is $\pi d^2/4$, and the void fraction is the void space divided by the total space, or $d^2/D^2$. Preferably the glass fibers have a void fraction within the range of from about 20 to about 50 percent. The fibers can be any size or shape suitable for reinforcement, although a preferred range for hollow glass fibers having a void fraction of 30 percent is diameters within the range of from about 25 to about 120 hundred thousandths inches (Ht).

In the preferred embodiment of the invention the amount of resin in the insulation and structural panel of the invention varies within the range of from about 5 to about 40 percent of the weight of the panel and the glass fibers comprise an amount within the range of from about 60 to about 95 percent of the weight of the panel. Measurements of weights do not include the weights of any facing or coating on the panel. Preferably, the glass fibers comprise an amount within the range of from about 80 to about 95 percent of the weight of the panel.

In order to enhance the insulation ability of the panel, a reflective coating can be applied to the interior surface 20 of the glass fiber reinforcements. The reflective coating can be any coating suitable for increasing the reflectivity of infrared radiation from the surface of the glass fiber, such as a metallized coating. The primary usefulness of the reflective coating is in reducing the transmission and absorption of the radiated energy, which becomes an important part of the total heat flow in low mass composite matrix systems, such as a foam.

Reflectivity is described as the backscattered fraction of an incident energy directed at an object. When radiant energy strikes a glass fiber surface, the energy is generally split up into three parts, absorbed energy, transmitted energy and reflected energy. Reflected radiant energy through glass is small at certain infrared wavelengths, such as the vicinity of 9 microns, where glass is highly absorbing. Reflected radiant energy through glass can be important at smaller or larger wavelengths where glass is more transparent. For purposes of this specification and claims, "reflectivity" is defined as the fraction of radiant energy incident on a surface which is reflected from the surface, where the incident radiant energy is at wavelengths within the range of from about 0.3 and 6.0 microns.

The insulation and structural panel of the invention has a potential for high tensile strength and modulus. Preferably, the tensile strength is greater than 20,000 pounds per square inch (psi), and more preferably is greater than 80,000 psi. The modulus for the resin alone is preferably greater than 100,000, while the reinforced resin preferably has a modulus greater than about 600,000 psi.

An insulation and structural panel according to the invention could be made by foaming a polyvinylchloride resin with air as the blowing agent. The polyvinylchloride resin has a thermal conductivity of about 0.87 BTU-in/hrFt$^2$°F. in the unfoamed and unreinforced condition. It is estimated that in the foamed, but unreinforced condition, the resin would have a density of about 10 Lb./Ft$^3$, and a thermal conductivity of about 0.24 BTU-in/hrFt$^2$°F. Hollow glass fibers having a void fraction of about 30 percent would be included in the composite in a fabric form. The polyvinylchloride foam should be worked into the hollow fiber fabric by a pinch rolls. The glass fibers would comprise about 85 percent by weight of the final insulation and structural product. It is estimated that the thermal conductivity of the product would be about 0.6 BTU-in/hrFt$^2$°F.

It will be evident from the foregoing that various modifications can be made to this invention. Such, however, are considered as being within the scope of the invention.

INDUSTRIAL APPLICABILITY

The invention can be useful as insulation and structural panels for the construction industry, such as for use as wall panels for walk in coolers, over the road containers, and portable hot or cold boxes.

I claim:

1. An insulation and structural panel comprising a resin matrix which has a thermal conductivity less than about 1.3 BTU-in/hrFt$^2$°F. in the unreinforced condition, and hollow glass fibers, the hollow glass fibers having a void fraction within the range of from about 20 to about 50 percent, the resin matrix constituting an amount within the range of from about 5 to about 40 percent of the weight of the panel, the glass fibers constituting an amount within the range of from about 60 to about 95 percent of the weight of the panel, and the panel having a thermal conductivity less than about 1.6 BTU-in/hrFt$^2$°F.

2. The insulation and structural panel of claim 1 in which the glass fibers comprise an amount within the range of from about 80 to about 95 percent of the weight of the panel.

3. The insulation and structural panel of claim 1 in which the glass fibers have a reflective coating on their interior surfaces, the reflectivity of the interior surfaces being greater than about 0.4.

4. The insulation and structural panel of claim 1 in which the reflectivity is greater than about 0.6.

5. The insulation and structural panel of claim 1 in which the resin has a thermal conductivity less than about 0.8 BTU-in/hrFt$^2$°F. in the unreinforced condition.

6. The insulation and structural panel of claim 5 in which the resin is foamed so that it has a thermal conductivity less than about 0.6 BTU-in/hrFt$^2$°F. in the unreinforced condition.

7. The insulation and structural panel of claim 6 in which the resin matrix is one or more resins selected from the group consisting of polyvinylchloride, polycarbonate, polystyrene, polypropylene, phenolic, epoxy, polyester and polyurethane.

8. The insulation and structural panel of claim 1 in which the resin matrix is one or more resins selected from the group consisting of polyvinylchloride, polycarbonate, polystyrene, polypropylene, phenolic, epoxy, polyester and polyurethane.

9. The insulation and structural panel of claim 1 comprising a surface coating on at least one of the major faces of the panel.

10. The insulation and structural panel of claim 1 in which the glass fibers are evacuated to a pressure of $10^{-4}$ torr.

11. The insulation and structural panel of claim 1 in which the glass fibers contain a low conductivity gas having a thermal conductivity less than about 0.15 BTU-in/hrFt$^2$°F.

12. An insulation and structural panel comprising a foamed resin matrix which has a thermal conductivity less than about 0.6 BTU-in/hrFt$^2$°F. in the unreinforced condition, and hollow glass fibers, the hollow glass fibers having a void fraction within the range of from about 20 to about 50 percent, the hollow glass fibers comprising an amount within the range of from about 60 to about 95 percent of the weight of the panel, and the panel having a thermal conductivity less than about 1.6 BTU-in/hrFt$^2$°F.

13. The insulation and structural panel of claim 12 in which the glass fibers have a reflective coating on their interior surfaces, the interior surfaces having a reflectivity greater than about 0.4.

14. The insulation and structural panel of claim 13 in which the resin matrix is one or more resins selected from the group consisting of polyvinylchloride, polycarbonate, polystyrene, polypropylene, phenolic, epoxy, polyester and polyurethane.

15. The insulation and structural panel of claim 12 in which the resin matrix is one or more resins selected from the group consisting of polyvinylchloride, polycarbonate, polystyrene, polypropylene, phenolic, epoxy, polyester and polyurethane.

16. The insulation and structural panel of claim 14 comprising a surface coating on at least one of the major faces of the panel.

17. The insulation and structural panel of claim 12 in which the glass fibers are evacuated to a pressure of $10^{-4}$torr.

18. An insulation and structural panel comprising a resin matrix which has a thermal conductivity less than about 1.3 BTU-in/hrFt$^2$°F. in the unreinforced condition, and hollow glass fibers, the hollow glass fibers having a void fraction within the range of from about 20 to about 50 percent, the panel having a surface coating on at least one of the major faces of the panel, and the panel having a thermal conductivity less than about 1.6 BTU-in/hrFt$^2$°F.

19. The panel of claim 18 in which the resin matrix has a thermal conductivity within the range of from 0.08 BTU-in/hrFt$^2$°F. to about 1.3 BTU-in/hrFt$^2$°F. in the unreinforced condition, and the panel has a thermal conductivity within the range of from about 0.3 BTU-in/hrFt$^2$°F. to about 1.6 BTU-in/hrFt$^2$°F.

20. The insulation and structural panel of claim 19 in which the resin is foamed so that it has a thermal conductivity less than about 0.6 BTU-in/hrFt$^2$°F. in the unreinforced condition, and the hollow glass fibers have a reflective coating on their interior surfaces, the interior surfaces having a reflectivity greater than about 0.4.

* * * * *

UNITED STATES PATENT AND TRADEMARK OFFICE

CERTIFICATE OF CORRECTION

PATENT NO : 5,683,799
DATED : November 4, 1997
INVENTOR(S) : John L. Olinger

It is certified that error appears in the above-identified patent and that said Letters Patent is hereby corrected as shown below:

Column 6, lines 21-28, should read:

18. An insulation and structural panel comprising a resin matrix which has a thermal conductivity less than about 1.3 BTU-in/hrFt$^{2o}$F. in the unreinforced condition, --the resin matrix comprising an amount within the range of from about 5 to about 40 percent of the weight of the panel,-- and hollow glass fibers, the hollow glass fibers having a void fraction within the range of from about 20 to about 50 percent, --the glass fibers constituting an amount within the range of from about 60 to about 95 percent of the weight of the panel,-- the panel having a surface coating on at least one of the major faces of the panel, and the panel having a thermal conductivity less than about 1.6 BTU-in/hrFt$^{2o}$F.

Signed and Sealed this

Seventeenth Day of August, 1999

*Attest:*

Q. TODD DICKINSON

*Attesting Officer*

*Acting Commissioner of Patents and Trademarks*